US006682394B2

(12) United States Patent
Tilbor et al.

(10) Patent No.: US 6,682,394 B2
(45) Date of Patent: Jan. 27, 2004

(54) RADIO CONTROLLED TWO WHEELED VEHICLE

(75) Inventors: Neil Tilbor, New Smyrna Beach, FL (US); Michael G. Hetman, New Smyrna Beach, FL (US)

(73) Assignee: Leynian Ltd. Co., New Smyrna Beach, FL (US)

( * ) Notice: Subject to any disclaimer, the term of this patent is extended or adjusted under 35 U.S.C. 154(b) by 0 days.

(21) Appl. No.: 10/288,801

(22) Filed: Nov. 6, 2002

(65) Prior Publication Data

US 2003/0104758 A1 Jun. 5, 2003

Related U.S. Application Data

(63) Continuation-in-part of application No. 09/723,068, filed on Nov. 27, 2000, now Pat. No. 6,482,069.

(51) Int. Cl.[7] ..... A63H 17/16

(52) U.S. Cl. ..... 446/440; 446/286; 446/456; 446/462; 446/468

(58) Field of Search ..... 446/233, 234, 446/279, 286, 288, 440, 456, 462, 468, 469, 470

(56) References Cited

U.S. PATENT DOCUMENTS

| | | | |
|---|---|---|---|
| 560,103 | A | 5/1896 | Martin |
| 4,290,228 | A | 9/1981 | Goldfarb et al. |
| 4,601,674 | A | 7/1986 | Koizumi |
| 5,368,516 | A | 11/1994 | Hoeting et al. |
| 5,709,583 | A | 1/1998 | Suto et al. |
| 5,820,439 | A | 10/1998 | Hair, III |
| 6,095,891 | A | 8/2000 | Hoeting et al. |

*Primary Examiner*—Kien T. Nguyen
(74) *Attorney, Agent, or Firm*—Keusey, Tutunjian & Bitetto, P.C.

(57) ABSTRACT

A radio controlled two wheeled vehicle incorporates flywheel technology in addition to a unique disposition of motors, gears and electronics provides superior stability and mobility during operation. A flywheel is disposed in the at the lowest central point of the vehicle and is independently driven by an motor independent from the drive motor. The independent operation of the flywheel from the drive system of the two-wheeled vehicle provides increased stability at slower speeds and eliminates the need for complex transmission systems between the drive system motor and the flywheel. In the bicycle embodiment, an action figure having movable joints is releasably attachable to the bike and provides realistic animation during the bike operation.

22 Claims, 17 Drawing Sheets

RADIO CONTROLLED TWO WHEELED VEHICLE

RELATED APPLICATION INFORMATION

This application is a Continuation-in-Part of U.S. patent application Ser. No. 09/723,068, filed Nov. 27, 2000 now U.S. Pat. No. 6,482,069.

BACKGROUND OF THE INVENTION

1. Field of the Invention

The present invention relates radio controlled toys, and more particularly, to a radio controlled two wheeled vehicle such as a bicycle or motorcycle.

2. Description of the Related Art

Radio controlled or remotely controlled toys have become specialty items in the toy market. Radio controlled vehicles dominate in this market and as such, manufacturers attempt to duplicate well known vehicles as well as the latest in automotive development.

New radio controlled toys are departing from the standard vehicle configuration and are incorporating radio control technology into other more interesting toys. The shape and configuration of these new radio controlled toys is dependent on the design of the power, transmission and other systems necessary to make the toy work. Furthermore, the design of such toys is integral in the toy's ability to perform dynamic stunt maneuvers and actions while maintaining stability for continuous, uninterrupted enjoyment of the toy. Some examples of these important design consideration are the dimensions of the device, the mass (power to weight ratio) of the device and the location of the toy's center of gravity. In view of these design requirements, toy designers are significantly limited in the shape of the toy they can make that includes all the circuitry, power source and control systems required for radio controlled toys.

In recent years, there has been increased interest in toy motorcycles, and more particularly toy motorcycles which are radio controlled with respect to speed and steering. As will be appreciated by one skilled in the art, toy motorcycles or bicycles having two wheels present balance and steering problems which are more complex and far different from problems encountered with four wheeled radio controlled toy vehicles. These problems have been approached in a number of different ways by the prior art.

U.S. Pat. No. 5,709,583 teaches a radio controlled two-wheeled motorcycle toy that utilizes an electromagnetic system that is connected to the front fork via a resilient mechanism for selectively enabling the steering of the vehicle during operation. Also disclosed are a pair of auxiliary wheels which are integral to the stability of the toy. When the toy is operated and the steering mechanism is actuated to turn the vehicle, the centrifugal force generated which would otherwise cause the toy to fall over in the steered direction is controlled by the corresponding auxiliary wheel contacting the ground. The auxiliary wheels contact the ground to maintain the toy in an upright position and prevent it from tipping over.

U.S. Pat. No. 4,966,569 teaches a radio controlled two-wheeled which includes a horizontal, longitudinally extending shaft to which a battery pack containing frame is pivotally suspended in pendulum fashion. The front wheel of the toy motorcycle is mounted to a support mechanism comprising a fork, and a pivot member located forwardly of the fork. The battery pack is swung to the right or left in pendulum fashion by a radio controlled servo. The battery pack mechanism is operatively connected to the front wheel support, so that it tilts in the same direction as the battery pack is shifted, causing the toy motorcycle to turn in that direction. In addition, a simulated rider mounted on the toy motorcycle contains weights within its body which shift along with the shifting of the battery pack. The toy motorcycle is provided with a stand for supporting the rear wheel thereof at starting.

U.S. Pat. No. 4,902,271 teaches another approach wherein a toy motorcycle is provided with a front frame supporting the front wheel and a rear frame supporting the rear wheel and a drive motor therefor. The rear frame, wheel and motor are tiltable with respect to the front frame to initiate left and right turns. Tilting of the rear frame is brought about by a servo mounted in the front frame and radio controlled. Auxiliary legs having wheels on their free ends project outwardly from both sides of the toy motorcycle, to maintain the toy motorcycle substantially upright when stopped.

U.S. Pat. No. 4,342,175, for example, teaches a two-wheeled motorcycle having a frame or chassis which carries a drive motor, a radio, a servo mechanism, and a power source. The servo is provided with a shaft which supports a weight in the manner of an inverted pendulum. By shifting the weight to the right or left, the toy motorcycle is caused to lean to the right or left. The front wheel of the motorcycle is supported by a fork which is attached to a pivot assembly located ahead of the fork. As a consequence of this construction, when the motorcycle is caused to lean in one direction or the other by the servo mounted weight, the front wheel will turn in the direction of that lean. The motorcycle is provided with a crash bar on each side which will help to maintain the motorcycle substantially upright during a turn and when standing still.

In an effort to further the stunt capabilities of radio controlled toys, toy designers have started implementing the use of flywheels to provide gyroscopic stabilization and to communicate positional change information to electronic and electromechanical stabilization systems in a wide variety of aeronautical, navigational, toy and novelty devices. An example of such flywheel implementation is shown in U.S. Pat. No. 6,095,891.

U.S. Pat. No. 6,095,891 discloses a remote controlled toy vehicle with improved stability including a flywheel mounted in the rear wheel. A clutch assembly operatively connects the flywheel to the rear wheel propulsion system so as to enable the rotation of the flywheel at speeds faster than the rear wheel during operation. In this invention, the flywheel rotates only when the propulsion system is activated and the rear wheel of the vehicle is being driven in a predetermined direction.

The use of flywheels increases the possibilities of different radio controlled toy designs and is ideal for implementation into a two wheeled vehicle to increase its stability and thereby the range of maneuvers it can make during operation. As such, it is desirable to provide a radio controlled two-wheeled vehicle (e.g., bicycle) that is capable of simulating the balance provided by a human rider in a real bicycle, and performing various dynamic stunts, while maintaining stability and balance during operation. Since a bicycle is the most dynamic two wheeled vehicle design for performing stunt action maneuvers, the bicycle is a desirable candidate for conversion into a radio controlled toy.

SUMMARY OF THE INVENTION

It is therefore an object of the invention to provide a radio controlled two wheel vehicle that incorporates flywheel technology in order to increase the stabilization of the toy and thereby increase the playability, stability and maneuverability of the toy.

It is another object of the invention to provide a radio controlled two wheeled vehicle such as a motorcycle that incorporates flywheel technology in order to increase the stabilization of the toy and thereby increase the stunt action and maneuverability of the toy.

This and other objects are achieved in accordance with an embodiment of the present invention in which the two wheel radio controlled vehicle includes power, stabilization and steering systems to enable a variety of realistic and stunt actions. The disposition of a gyroscopic stabilization system in the crankshaft area of the two wheeled bicycle not only lowers its center of gravity, but also increases the stability and diversity of stunt action motion while adding to the realism of appearance during operation.

In accordance with an embodiment of the invention, the two-wheeled radio controlled toy vehicle includes a chassis having front and rear ends and a central portion between the ends and front and rear wheels operatively connected to and providing support for the respective front and rear ends. A front wheel fork assembly is operatively connected to the front end of the body and rotatably supports the front wheel of the bicycle.

A steering mechanism connected to the front wheel fork is operative to steer the toy vehicle in a desired direction. A drive system selectively drives the rear wheel of the toy vehicle in response to radio commands received from a user operated remote transmitter. A stability system having its own separate drive and transmission from the drive system increases the stability of the toy vehicle during operation (due to continuous, uninterrupted operation of the stability system).

The electronic circuitry and power supply necessary for operating the drive, stability and steering mechanisms in response to user received radio commands from a remote transmitter are also included within the design.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings wherein like reference numerals denote similar elements throughout the views.

DETAILED DESCRIPTION OF PREFERRED EMBODIMENTS

Figure 1:
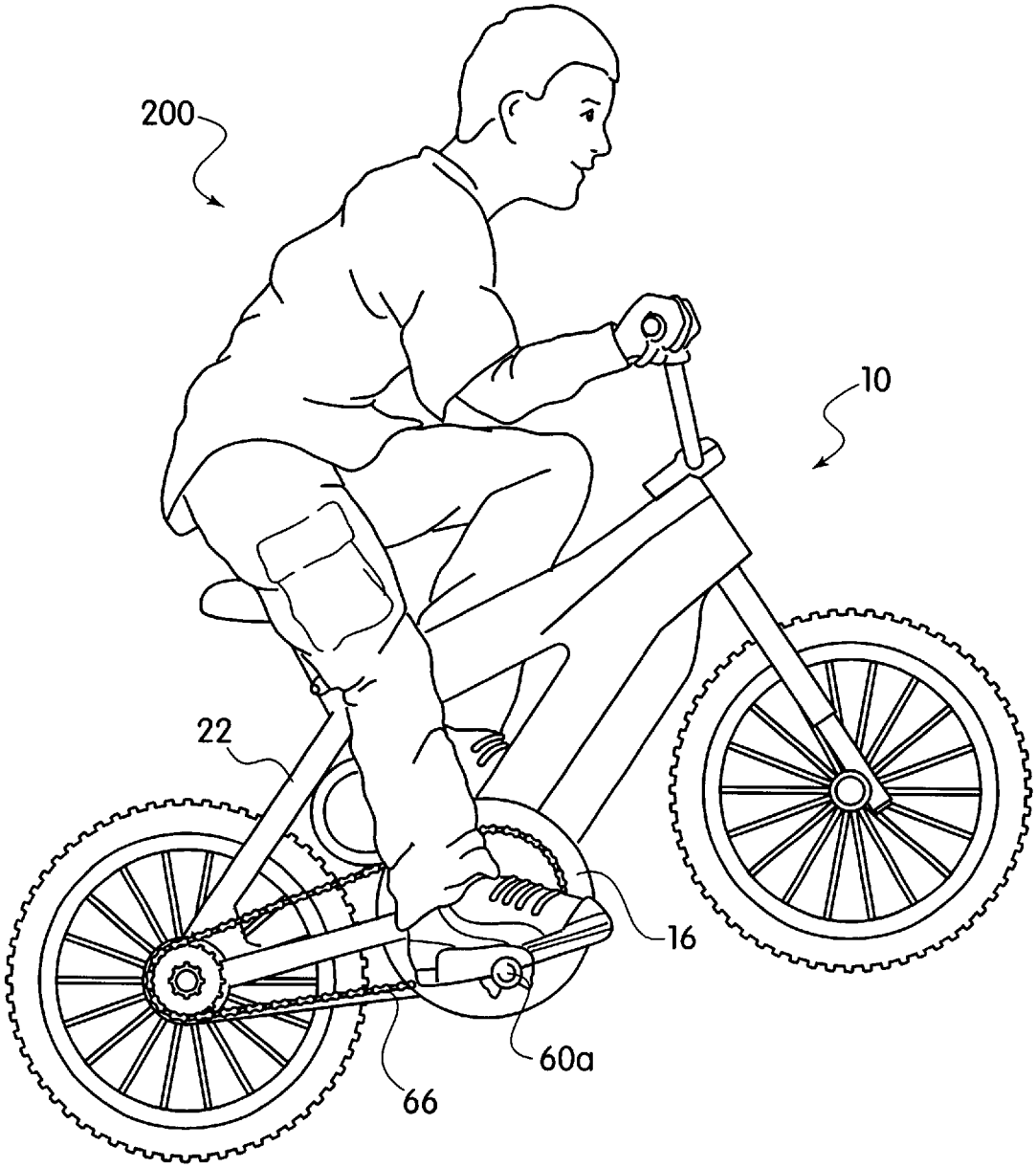
FIG. 1 is a side view of a radio controlled two wheel vehicle (bicycle) with an adjustable action figure according to an embodiment of the invention.
Figure 8:
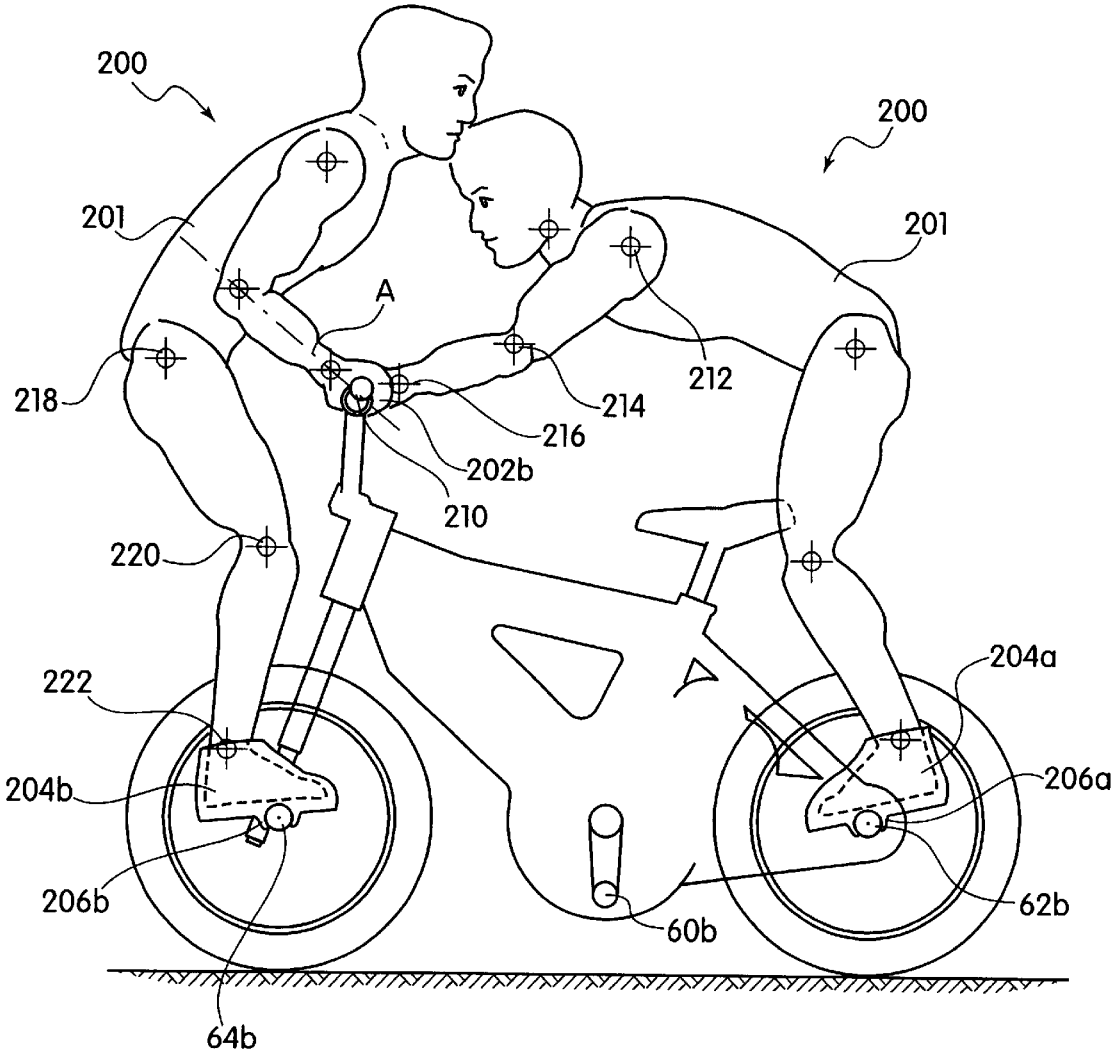
FIG. 8 is a side view of the radio controlled two wheeled vehicle showing the action rider figure in various stunt positions according to an embodiment of the invention.

FIG. 1 shows a side view of the radio controlled bicycle 10 according to an embodiment of the invention. As shown, an action figure 200 is disposed on bike 10 and is molded and jointed to provide a life like look and action which will be described later with reference to FIG. 8. Figure 200 can be clothed and includes realistic looking shoes or boots that are releasably connected to the pedals or stunt tubes (pegs that are mounted to the ends of the front and rear axles, four total).

Figure 2A:
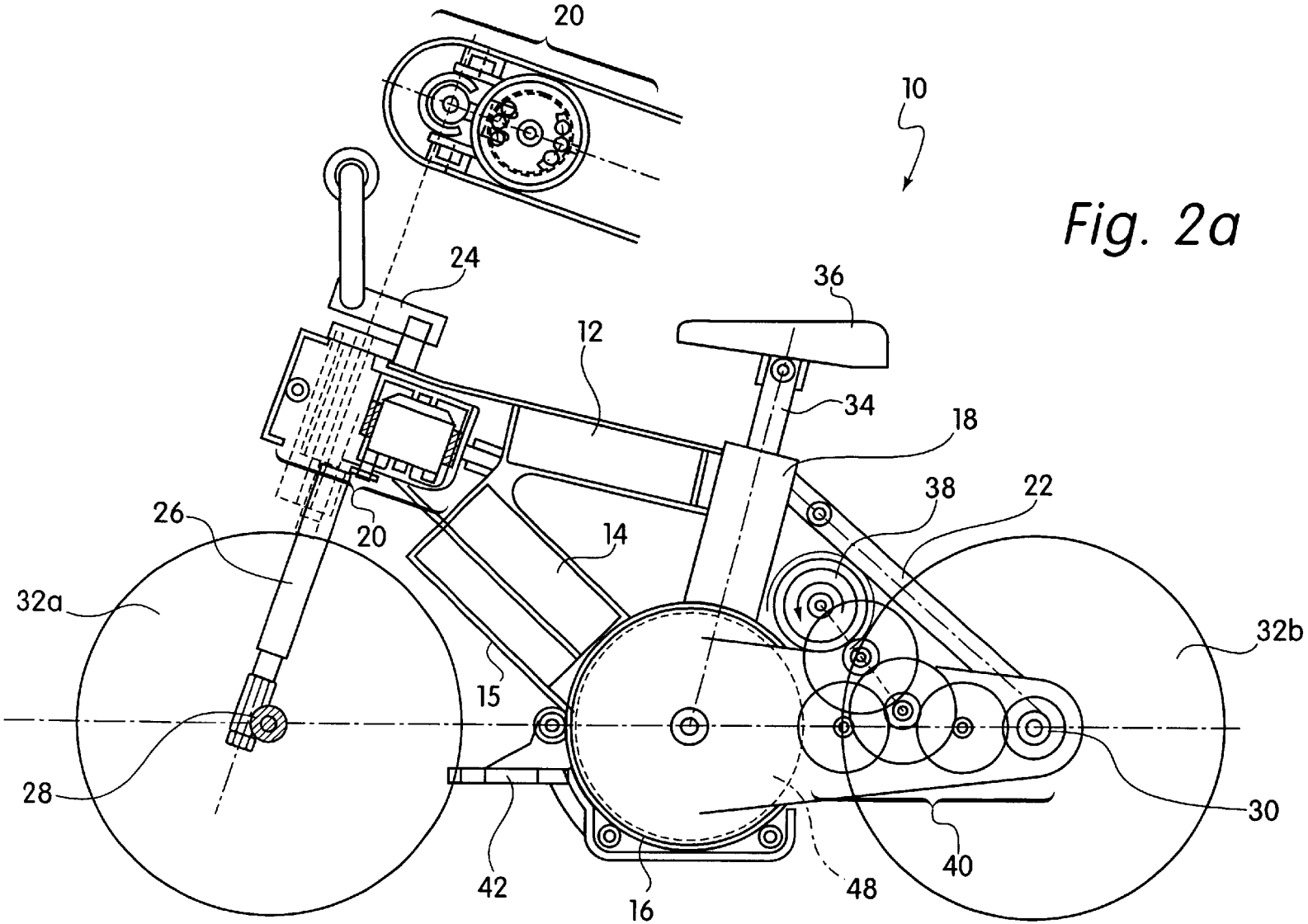
FIG. 2*a* is a schematic side view of the radio controlled bicycle without the action figure according to an embodiment of the invention.

Referring to FIGS. 1 and 2*a,* bike 10 is made up of a top tube 12, a down tube 14, a crankshaft/flywheel, radio printed circuit board, housing 16, a seat tube 18, a steering assembly 20, a seat stay tube 22, a handle bar assembly 24, a front fork 26 (with spring suspension) having an axle 28 and a rear axle 30 at the base of the seat stay tube 22. Wheels 32*a* and 32*b* are rotatably mounted to the front and rear axles, 28 and 30, respectively. A seat post 34 is mounted within seat tube 18 and includes a seat 36 mounted thereon. Bike 10 can include a stabilizer 42 (FIGS. 2, 3*c* and 3*d*) which serves to prevent the bike from falling over when it is stopped or impacted during operation.

A drive motor 38 is preferably disposed between the seat tube 18 and seat stay tube 22, and a plurality of gears 40 operatively connect drive motor 38 to the rear axle 30 and to a reductions gear 48 (FIG. 4) for pedal action during operation. Gears 40 can be any suitable known type of gearing system, provided that the necessary gear reduction between the drive motor 38 and the rear axle 30 is achieved. Gears 40 act as one transmission on board bike 10. Those of skill in the art will recognize that the arrangement, number and size of gears 40 are dependent on the motor and wheel size and therefore can be changed without departing from the spirit of the present invention.

Figure 2B:
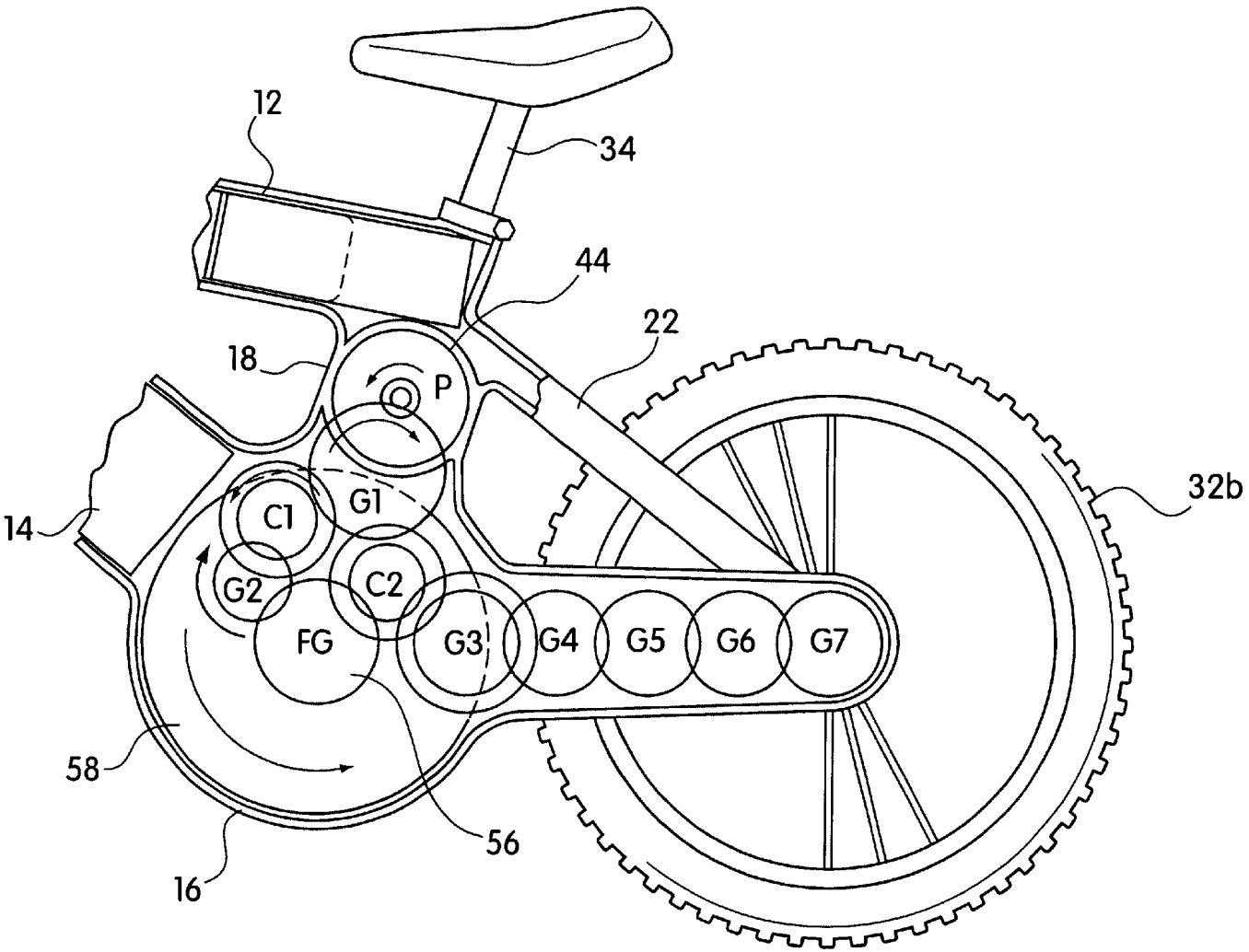
FIG. 2*b* is schematic side view of the radio controlled two wheel vehicle according to another embodiment of the invention.
Figure 2C:
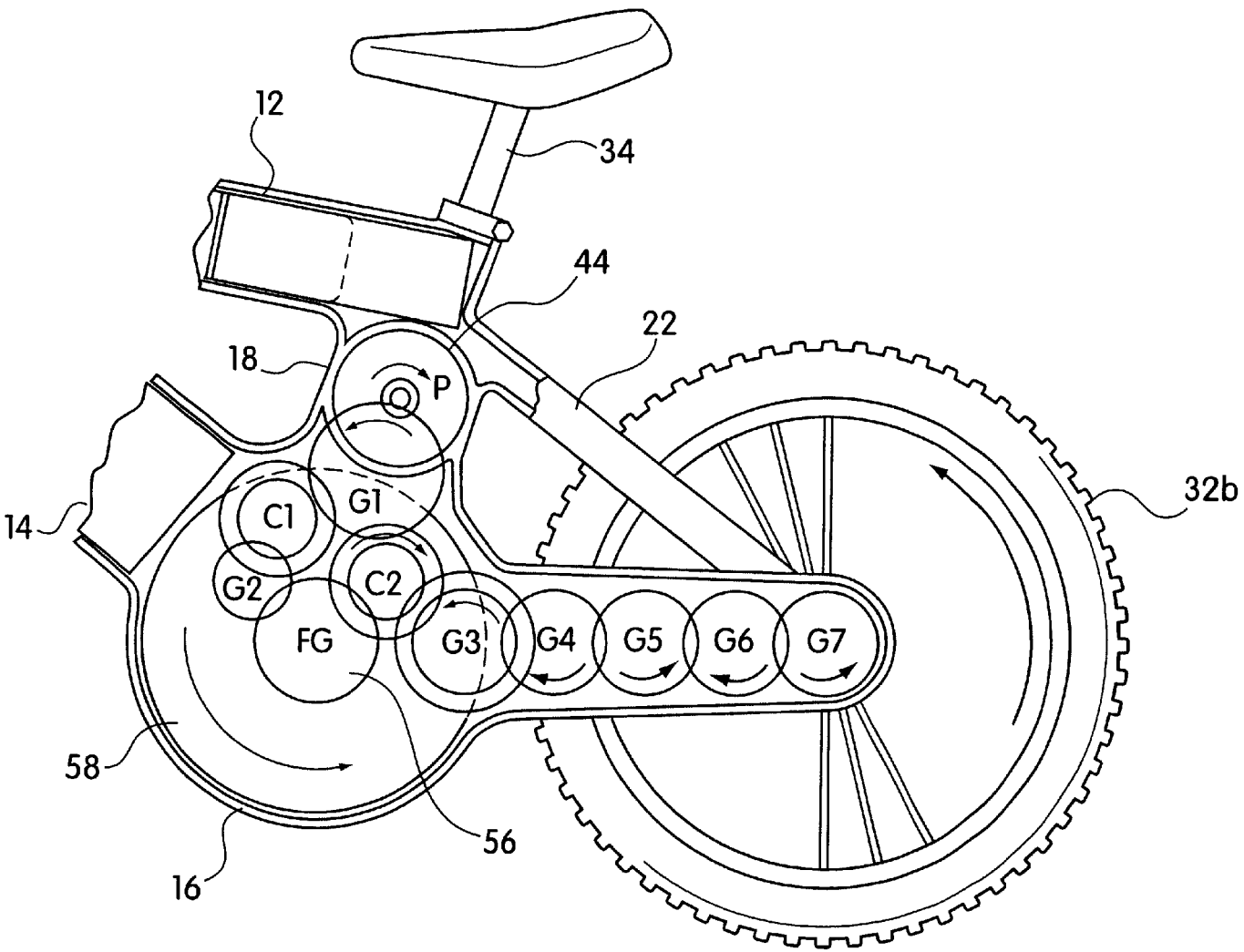
FIG. 2*c* is a schematic side view of the radio controlled two wheel vehicle according to another embodiment of the invention.

FIGS. 2*b* and 2*c* show another embodiment where the motor 38 is eliminated and one motor 44 disposed in the seat tube 18 is operable to drive both the flywheel 58 and the rear wheel 32*b*. According to this embodiment, when the remote receiver on the bike is powered on, and there is no signal being received from the remote transmitter (not shown), motor 44 is operable and rotates constantly counter-clockwise. Through the application of gears G1 and G2, clutch mechanism C1 and flywheel gear 56, flywheel 58 is driven in a counter clockwise direction. Gears G3–G7 operably connect the rear wheel 32*b* to the motor 44 via a clutch C2. Thus, engagement or disengagement of clutch C2 determines whether the rear wheel is driven or not, respectively. Clutch C2 also enables the simultaneous operation of the flywheel and rear wheel drive. FIG. 2*c* shows the operation of gears G1 and G3–G7 when clutch C2 is engaged. As shown, when a radio signal is received indicating forward motion, the motor 44 reverses direction (i.e., rotates clockwise) and continues to drive the flywheel counter-clockwise through clutch C2. Clutches C1 and C2 can be, for example, sliding pin type clutches. As such, according to this embodiment, the flywheel is constantly driven in a forward (counter-clockwise) direction, and the rear wheel is simultaneously driven forward (with the flywheel "coasting" and not under direct power) when the direction of motor 44 is reversed (from its original counter-clockwise direction).

Figure 2D:
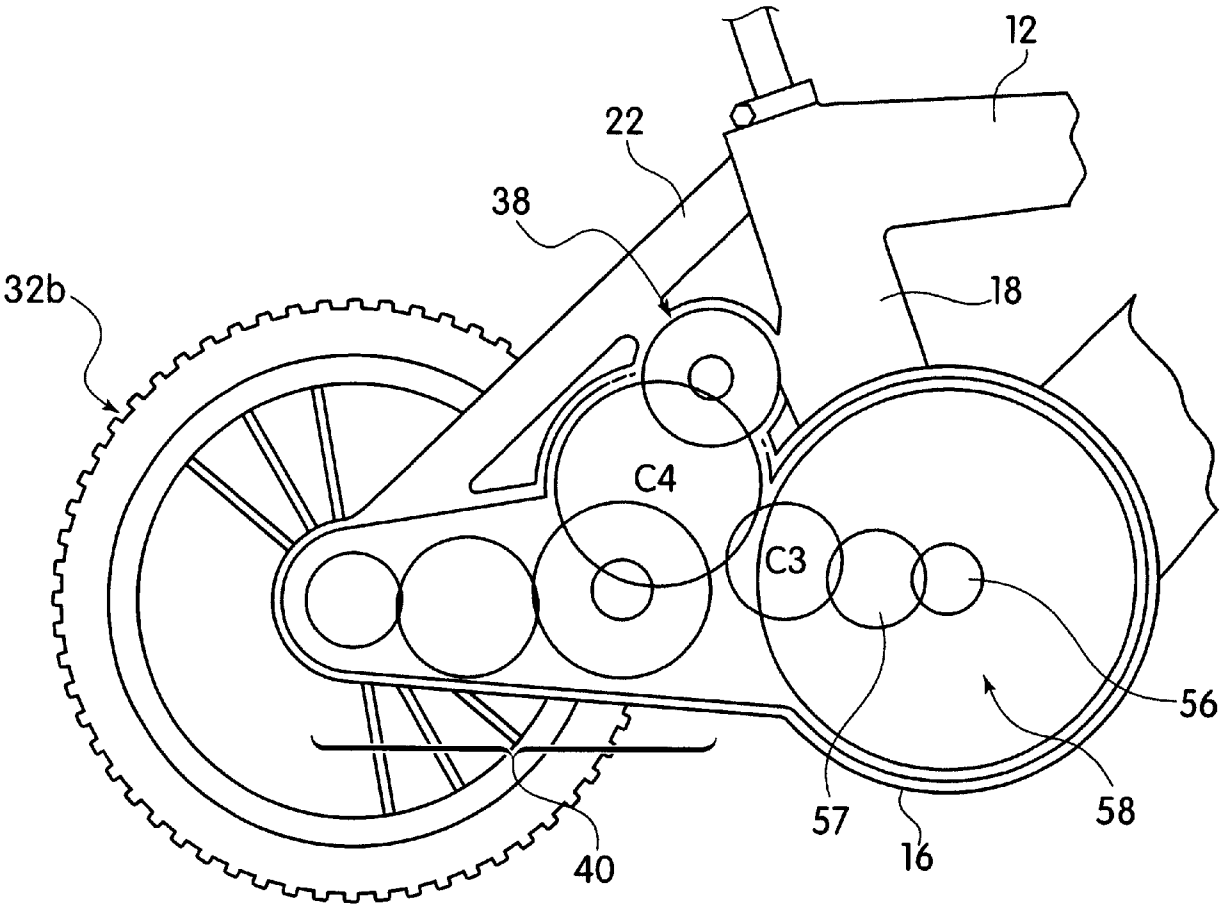
FIG. 2*d* is schematic side view of the radio controlled two wheel vehicle according to a further embodiment of the invention.

FIG. 2*d* shows yet another embodiment of the flywheel and rear wheel drive systems of the invention. In this embodiment, one motor 38 is disposed between the seat tube 18 and seat stay tube 22. A primary drive gear G operably connects gears 40 to motor 38 to thereby drive the rear wheel 32*b*, and a clutch C3 drives gear 57 which drives flywheel gear 56 and thereby flywheel 58. According to this embodiment, clutch C3 and idler gear 57 transmits drive power to the flywheel 58, via flywheel gear 56, from the main motor 38 only when the bike is under power and being driven through gears G8 and 40. Thus, when the drive power is removed via motor 38, flywheel 58 will continue to spin freely without drive power and thereby continue to provide gyroscopic stabilization even after the removal of drive power via motor 38 and clutch C3 (this can be referred to as a "coasting effect"). Those of skill in the art recognize that the embodiments of FIGS. 2*a*–2*d* are exemplary in nature and that other gear, clutch and drive systems may also be implemented without departing from the spirit of the invention.

Figure 3B:
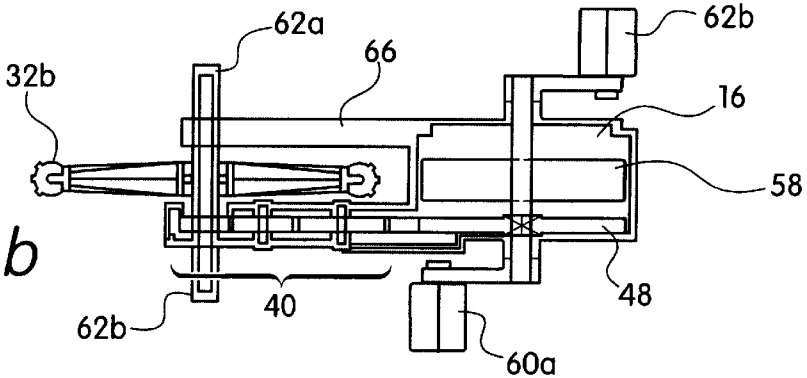
FIG. 3*b* is a schematic top view of the radio controlled two wheel vehicle according to an embodiment of the invention.
Figure 3A:
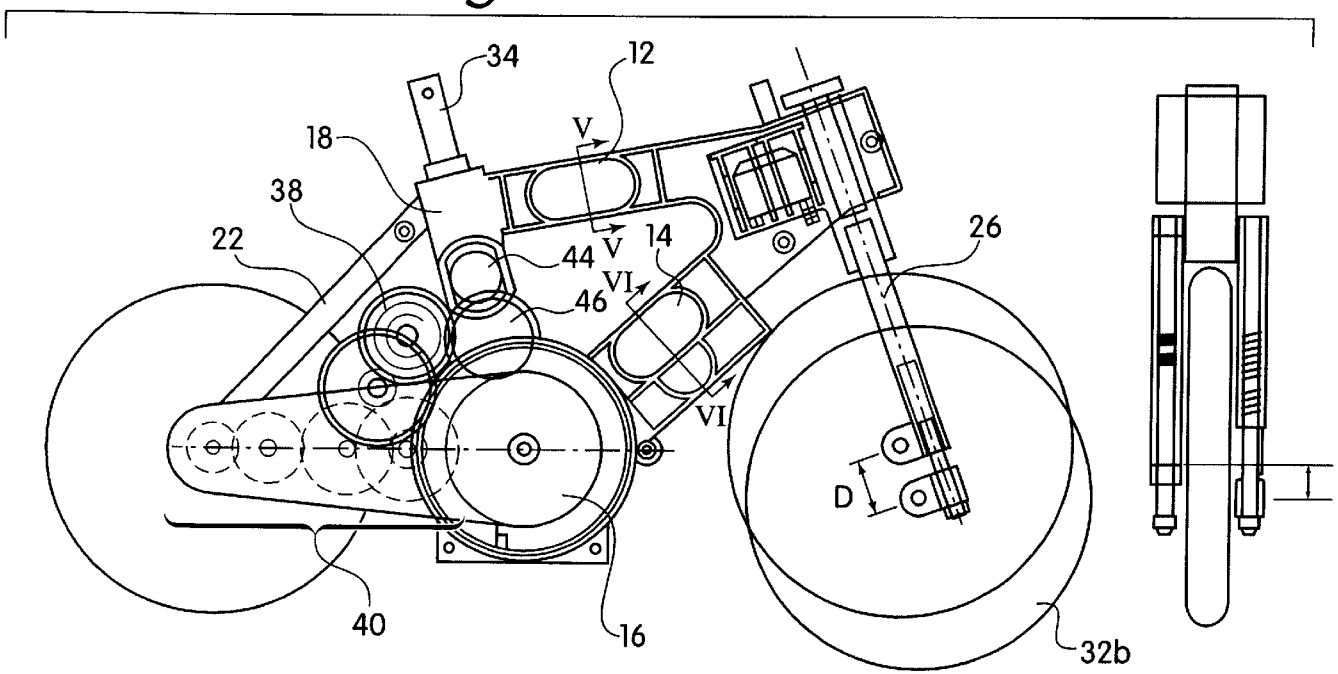
FIG. 3*a* is a schematic side view of the radio controlled two wheel vehicle according to an embodiment of the invention.
Figure 3C:
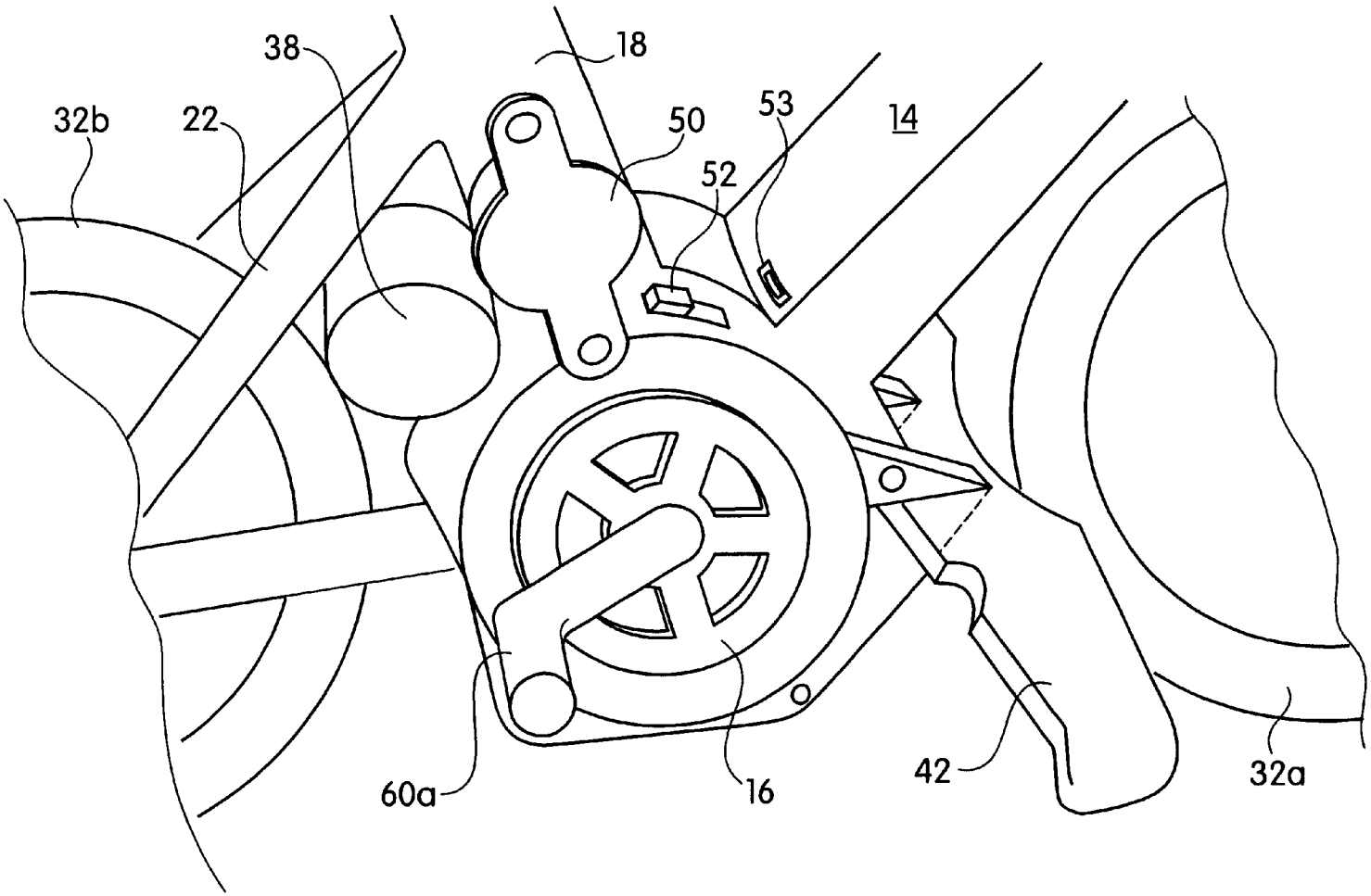
FIG. 3*c* is an enlarged perspective view of the crankshaft area of the radio controlled two wheel vehicle according to another embodiment of the invention.
Figure 4:
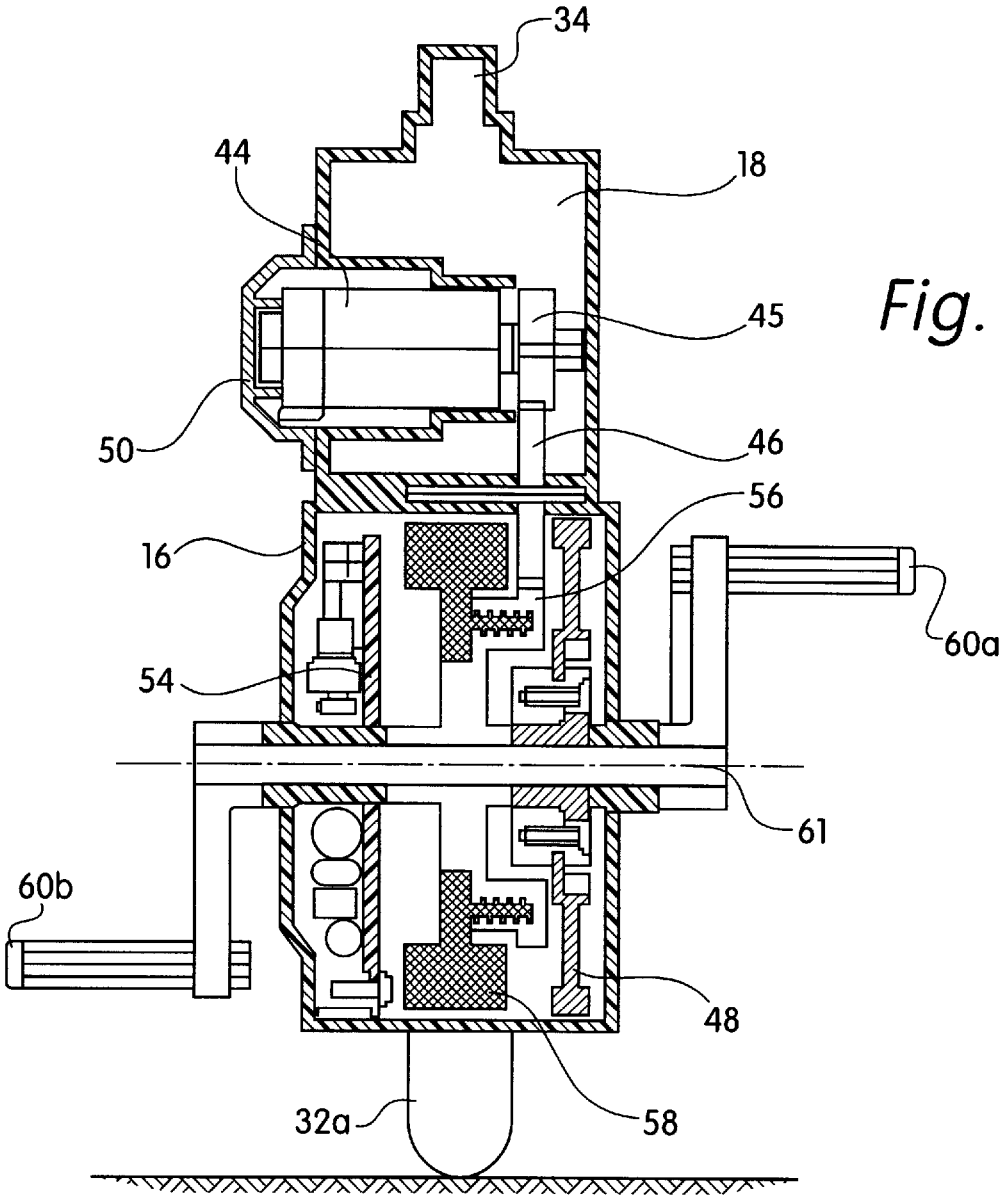
FIG. 4 is a cross-sectional view of the crankshaft area with flywheel according to an embodiment of the invention.

FIGS. 3*a* and 3*b* show various schematic views of bike 10 from different perspectives. FIG. 3*a* shows a side view of bike 10 with drive gears 40 arranged in a different configuration from that shown in FIG. 2. In addition, a flywheel motor 44 and a flywheel drive gear 46 are disposed in seat tube 18, and flywheel drive gear 46 is operatively coupled to flywheel gear 56 (FIG. 4). The flywheel drive motor 44, positioned within seat tube 18, can be accessed from one side by an access panel 50 (FIGS. 3*c* and 4). Front fork 26 includes a shock absorbing action that enables front wheel 32*b* to be displaced a limited amount D and thereby increase the stability of the bike during operation (especially over uneven surfaces).

FIG. 3*b* shows a partial top view of the bike 10 where drive gears 40 are disposed on one side of the bike and a realistic looking chain and crank assembly 66 (see also FIG. 1) is disposed on the other side of the bike. In a preferred embodiment, the crank assembly 66 is operatively connected with the drive gears 40 or the pedal action drive gear 48 (FIG. 4) such that the pedal crank rotates during operation to provide realistic bicycle riding appearance and action of the FIG. 200 on bike 10. The chain and rear sprocket are molded to provide the aesthetic appearance of a real bike but do not move during operation. In yet another contemplated embodiment, the chain and rear sprocket can be operably connected to the crank assembly 66 and rotate therewith during operation.

Figure 3D:
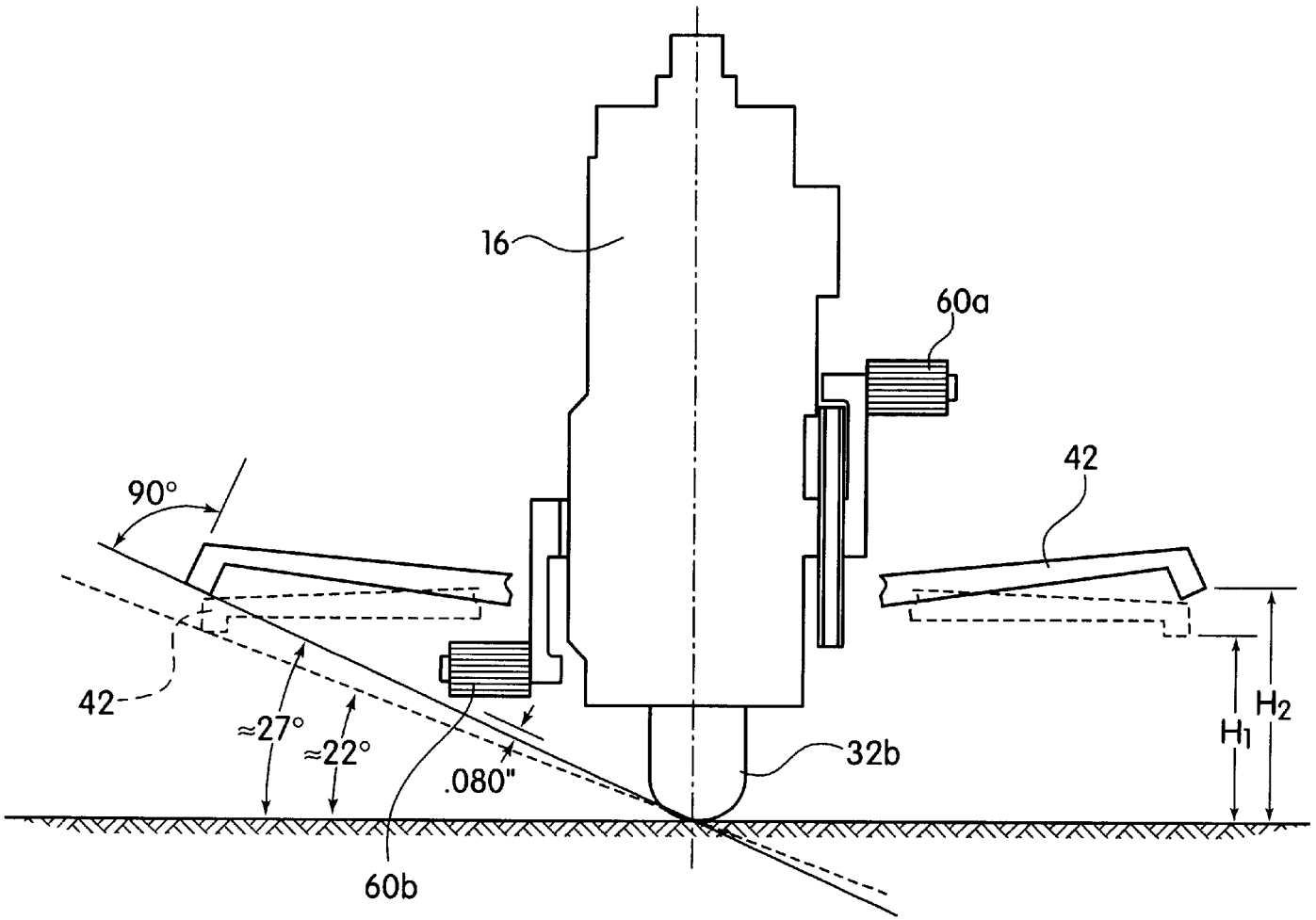
FIG. 3*d* is a plan view of a stabilizer according to various embodiments of the present invention.

FIG. 3*d* shows two embodiments of the position of stabilizer 42 according to the invention. In one embodiment, stabilizer 42 is perpendicularly disposed with respect to the crankshaft housing 16 (dotted embodiment), and in another embodiment, stabilizer 42 is angularly disposed with respect to the crankshaft housing 16. In both embodiments, the ends of the stabilizer with respect to the ground and the pedals 60*a* and 60*b* is an important design consideration and includes a height $H_1$ and $H_2$, respectively with respect to the ground. As can be seen, the ends of the stabilizer 42 must be such that when the bike tips over in either direction, the pedals 60*a* or 60*b* do not touch the ground and prevent subsequent re-erection of the bike through application of the drive motor and/or internal flywheel. Referring to the first embodiment (i.e., dotted configuration), the stabilizer 42 will touch the ground at approximately a 22 degree angle with respect to the ground. The second embodiment of stabilizer 42 (i.e., angularly disposed with respect to crankshaft housing) will contact the ground when the bike is tilted approximately 27 degrees on either side. In this second embodiment, the ends of the stabilizer 42 contact the ground such that a 90 degree angle between the ground and end of the stabilizer is produced. The height H2 is the largest distance at which the ends of stabilizer 42 may be disposed from the ground while still providing sufficient angular clearance of the pedals when the bike it tipped in either direction.

FIG. 4 shows a cross section of the crankshaft/flywheel housing 16 and seat tube 18 according to an embodiment of the invention. The flywheel drive motor 44 is mounted within the seat tube 18 with the access panel 50 provided on one side. Internally, drive motor 44 includes a gear 45 that is meshed with a flywheel drive gear 46 which is meshed with a flywheel gear 56. Flywheel gear 56 is fixedly connected to the flywheel 58. Flywheel motor 44 is a standard motor that is dedicated to driving the flywheel only and is not responsible for any other driving functions of the bicycle. Gears 45, 46 and 56 act as a second onboard transmission for bicycle 10. Thus, through the implementation of a separate motors and transmissions for propulsion and stability, the flywheel drive motor 44 can be always powered during operation, so as to maintain the rotation of flywheel 58 at all times. Flywheel motor 44 is capable of speeds in the range of 5–10,000 revolutions per minute (rpm), and in conjunction with the gear ratio of gears 45, 46 and 56 provide the necessary high speed rpm (e.g., 5–10, 000) for suitable gyroscopic force to be generated by the flywheel 58. This "always on" operation of the flywheel motor and thus constant rotation of flywheel 58, the stability of the bicycle is significantly increased during slower speeds. Thus, the flywheel 58 not only prevents the bicycle from falling over at slow speeds, but actually enable superior stability during slower movements, stunt actions and steering.

Those of skill in the art will recognize that the flywheel is preferably made of a dense material with the majority of its mass being disposed along its circumference. Preferably, the flywheel is made of metal, but may also be made of other suitable known materials. As is known, the flywheel weight, distribution of mass, diameter and rotational speed are all important in order to create gyroscopic stabilization effect.

Also contained within crankshaft/flywheel housing 16 is a circular circuit board 54 that is electrically connected to on/off switch 52 (FIG. 3*c*), batteries 13, steering system 20, motors 38 and 44 and includes all radio frequency (RF) receiver and control electronics required for operation of bike 10 using a remote control and radio transmitter device (not shown). The circular circuit boards shape allows sufficient surface area for electronic component mounting and does not compromise the crankshaft/flywheel housing's realistic overall appearance. A large reduction gear 48 is also disposed within the crankshaft/flywheel housing 16. The pedal gear 48 is driven by the drive gears 40 (e.g., see FIG. 2) which in turn drives pedal drive shaft 61 operatively connected to the pedals 60*a* and 60*b*, thereby rotating the pedals during operation. The rotation of pedals 60*a* and 60*b* while figure 200 is connected thereto results is a realistic appearance of the figure actually pedaling (powering) the bike due to the figures moveable joints at the knees 220 and hips 218. The circular circuit board 54 does not rotate about pedal drive shaft 61, while flywheel 58 rotates at high speeds around the slower rotating pedal drive shaft 61.

In accordance with other contemplated embodiments, the flywheel can be mounted in other positions on the bike. In one example, the flywheel may be mounted adjacent to the rear wheel. In another example, the flywheel can be contained within the front wheel of the bike. Those of ordinary skill in the art will recognize that the necessary drive transmissions and/or clutch assemblies would be added to such embodiments to enable independent operation of the flywheel with respect to the operation of the drive systems.

Figure 5A:
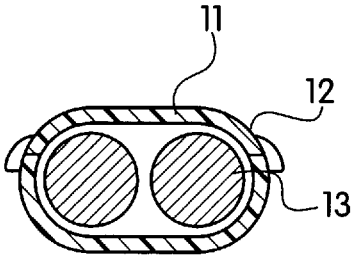
FIG. 5*a* is a cross-sectional view of the top tube of the two wheel vehicle taken along lines V—V of FIG. 3*a;*
Figure 5B:
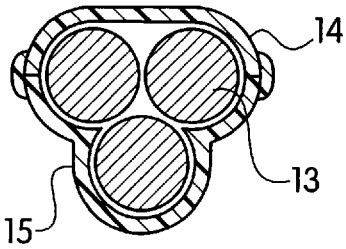
FIG. 5*b* is a cross-sectional view of the down tube of the two wheel vehicle taken along lines VI—VI of FIG. 3*a;*

FIGS. 5*a* and 5*b* show cross-sections of the top tube 12 and down tube 14, respectively. Tubes 12 and 14 fit tightly to batteries 13 for a realistic look. As shown, the batteries 13 for the bike 10 are contained within these two tubes as shown and can be removable through access panels 11 and 15 in tubes 12 and 14, respectively. Those of skill in the art will recognize that the access panels 11 and 15 may be secured onto their respective tubes through any suitable known type of connections, for example, a snap fitting cover or through the use of a cover and screws that secure the cover in place. Batteries 13 are removable and can be alkaline or carbon-zinc disposable types or nickel cadmium, nickel metal hydride, lithium ion, or any other suitable known type of rechargeable battery. In the embodiment shown, batteries 13 are preferably AA size. As shown, the batteries 13 are arranged side by side in the top tube 12, and are stacked in an inverted pyramid configuration in down tube 14. This arrangement enables a more realistic profile for top and down tubes 12 and 14, respectively. In other embodiments, the batteries 13 may be rechargeable and non-removable from the bike. In this instance, a charging jack 53 (FIG. 3*c*) can be added to the bike for providing the user with an electrical connection to the batteries for charging the same.

Figure 6:
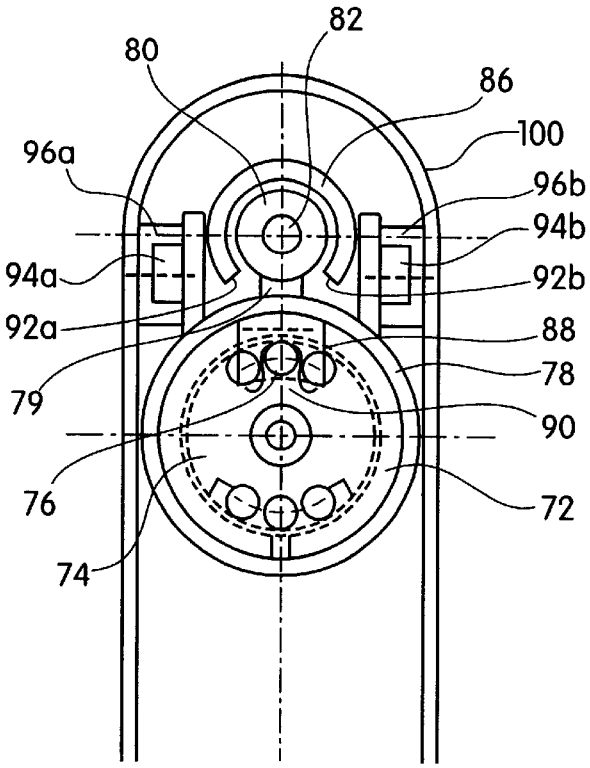
FIG. 6 is schematic top view of the steering mechanism of the radio controlled two wheel vehicle according to an embodiment of the invention.
Figure 7:
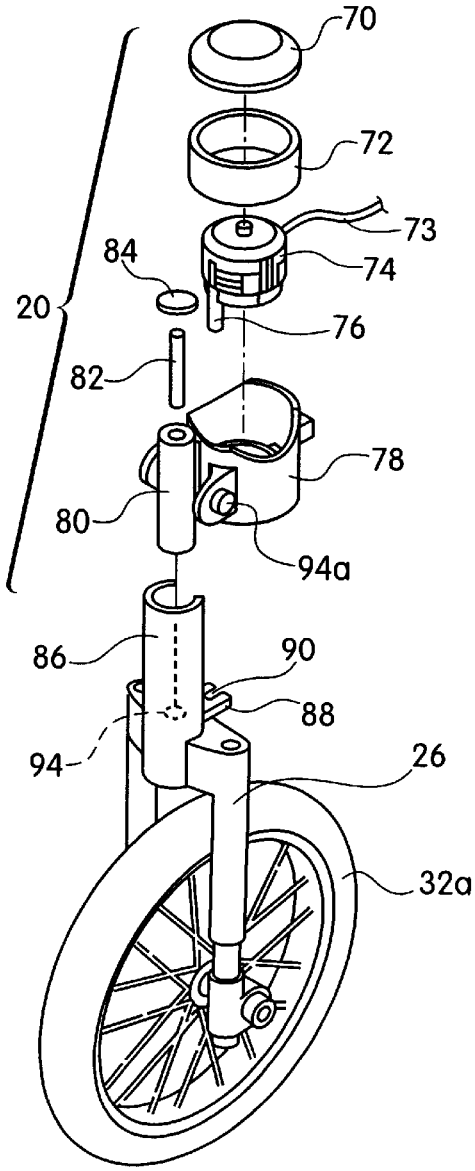
FIG. 7 is an exploded view of the steering mechanism of the radio controlled two wheel vehicle according to an embodiment of the invention.

FIGS. 6 and 7 show the steering system 20 according to an embodiment of the invention. Steering system 20 includes a C-shaped upper fork bushing sleeve 86 adapted to receive a cylindrical bushing 80 connected to the steering coil housing 78. A shaft or caster axle 82 is fitted through an axial bore through cylindrical bushing 80 and engages a hole 94 in the fork 26. Shaft 82 is preferably force fitted into hole 94 so that cylindrical bushing 80 can freely rotate about the shaft within C-shaped bushing sleeve 86. A disc or cap 84 can be provided to enclose the top of shaft 82, cylindrical bushing 80 and C-shaped bushing sleeve 86. An electromagnetic steering coil 74 is positioned within housing 78 and includes an downwardly extending peg 76 that passes through a hole (not shown) in the bottom of housing 78 and which engages in slot 90 of a steering guide tab 88. Steering coil 74 includes wires 73 that conduct the necessary voltage from the circuit board 54 to actuate the coil.

Steering coil 76 operates in conjunction with ring magnet 72 situated around coil 74 within housing 78. Thus, when the steering coil is actuated with a voltage having a predetermined polarity (i.e., predetermined based on the desired direction of steering), it will respond to a magnetic field created by ring magnet 72 and thereby cause the entire coil to rotate in one direction or the other within the housing 78. For example, assuming a left turn is desired, the steering coil 74 is actuated with a voltage having polarity which causes coil 74 to create a magnetic field which, when interacting with the magnetic field created by ring magnet 72, causes the coil to rotate in a clockwise direction. The clockwise rotation of coil 74 within housing results in downwardly extending peg 76 to also move clockwise while engaged in slot 90 of steering guide tab 88. The rotation of peg 76 within slot 90 causes the fork to be rotated about shaft 82 in a counterclockwise direction (i.e., to the left with respect to the bike).

One potential problem in a steering mechanism of this type is the possibility of over steering in one direction or the other, which can result in the tipping over of the bike. This over steering is not necessarily caused by physically steering too hard in one direction, but may also be caused by the centrifugal force created by turning the bike when traveling at high speeds in a substantially straight direction. Prior art methods for compensating for this physical phenomena include the implementation of side wheels that engage the ground at a predetermined tilt angle (see, for example, U.S. Pat. No. 5,709,583).

In order to accurately control the steering action of bike 10 and prevent tipping resulting from the centrifugal forces created by turning during forward momentum, the C-shaped bushing sleeve 86 includes C-slot edges 92*a* and 92*b* (FIG. 6) that function to limit the rotational movement of the cylindrical bushing 80 within the bushing sleeve 86. The limitation of the rotational movement of the cylindrical bushing 80 in conjunction with the stabilizing function of the operation of flywheel 58 effectively eliminates the tipping possibilities and provides superior user control over the operation of bike 10.

Using the above example of a left turn movement, during the clockwise rotation of coil 74 and thereby peg 76 within slot 90, the bushing support 79 connecting cylindrical bushing 80 to the coil housing 78 will hit or be stopped by C-slot edge 92*b* and thereby be prevented from over-steering in that direction. The same concept applies to the right turn action and opposing C-slot edge 92*a*. In a preferred embodiment, the flywheel speed is fixed at a top speed (e.g., 5–10k r.p.m.). However, other contemplated embodiments include the switching or modulation of the flywheel speed according to various control schemes of the bicycle. Thus, if the flywheel speed is selectively increased during a turning action, the stabilization of the bike 10 will be increased and will prevent tipping of the bike. In addition, power to the flywheel may be turned off when the bike is at a predetermined speed of operation or is simply traveling in a straight line. In this mode, the flywheel will continue to rotate due to the attained momentum.

Steering system 20 is enclosed by a housing 100. Housing 100 has notches or slots 96*a* and 96*b* which engage projections 94*a* and 94*b*, respectively, extending from steering coil housing 78.

FIG. 8*a* shows the action figure 200 in some of the many possible various stunt positions according to the invention. Action FIG. 200 is made up of a body 201 and includes a plurality of joints 212, 214, 216, 218, 220 and 222 disposed in the arms, shoulders, legs and hips. According to other embodiments, the wrist and/or forearm of the figure is rotatable about an axis A that is coaxial with the forearm itself. FIG. 200 includes shoes or boots 204*a* and 204*b* having C-shaped or other circular—like fittings adapted to be snapped onto the front stunt pegs 64*a* (not shown) and 64*b*, rear stunt pegs 62*a* (not shown) and 62*b* or pedals 60*a* and 60*b*. In addition, the figure's hands 202*a* and 202*b* are molded such that the fingers may releasably fit over the handlebars 210 and also on the stunt tubes for handstand type stunt actions. The C-shaped fittings of the shoes/boots and molded hands of the figure are such that during operation, figure 200 will not un-snap and detach, unless and until the bike 10 crashes, which impact can cause the FIG. 200 to release from the bike and therefore not get damaged from a crash. According to the disclosed embodiments, partial attachment of FIG. 200 is also possible (i.e., less than both hands and feet). This allows additional movement and articulation of the figure caused by inertia and movements of the bike.

Figure 9A:
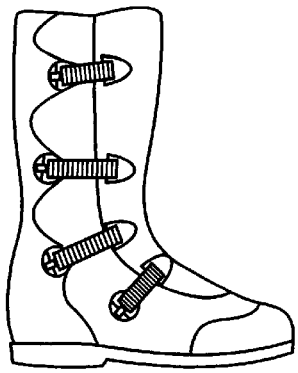
FIGS. 9*a*–9*d* are plan views of the boots of the action figure according to an embodiment of the invention.
Figure 9B:
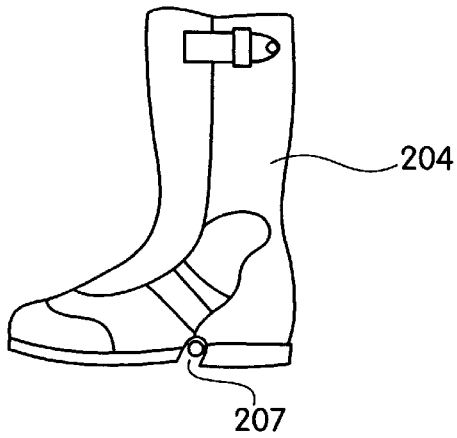
Figure 9C:
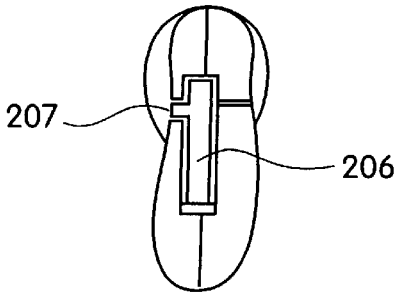
Figure 9D:
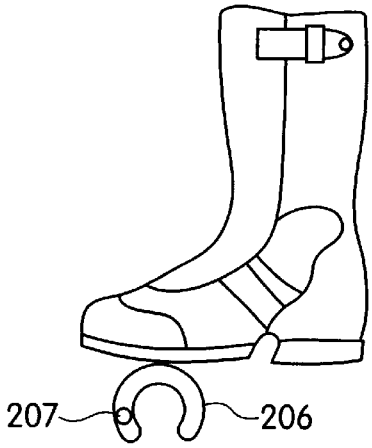

FIGS. 9*a*–9*d* show another embodiment of the boots 204 of the action figure. As shown, the clips 206 are retractable into the boot 204 and thereby enable the action figure to be removed from the vehicle and used apart from the radio controlled toy. The clip 206 is pivotally mounted within the boot 204 and includes a tab 207 that is accessible from the bottom of the boot (FIGS. 9*b* and 9*c*). The retractable clips 206 The retractable clips 206 can detent positively in down or up positions. When in the up position, the figure can be positioned to stand freely.

In accordance with other embodiments, action figure 200 has shoulder and hip joints that can be detented to hold the positions of the limbs with respect to the torso 201 during play. This embodiment is adapted for toy applications that do not necessarily require loose movement of the action figure limbs. For example, in the embodiment disclosed in FIGS. 11–14 (discussed later), the action figure's legs need not move with the pedal action of the bicycle in the embodiment shown in FIGS. 1–7. In another bicycle embodiment of the figure 200 the detent system of the hips and knees are designed such that the legs are free moving to simulate a bicycle riding style, yet when the figure is removed from the bicycle, the detents allow the legs to operate rigidly and maintain the figure in a standing or other desired position.

Figure 10A:
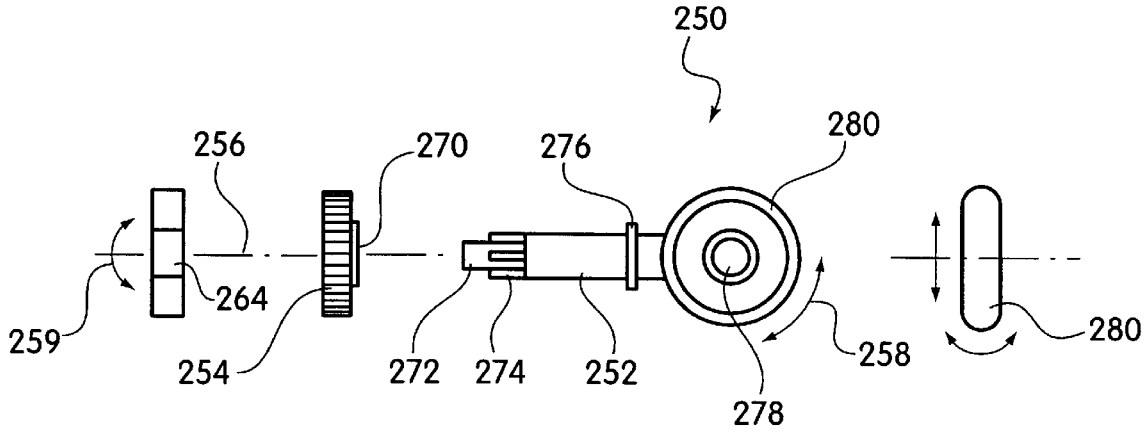
FIGS. 10*a* and 10*b* are schematic representations of the shoulder and hip joints of the action figure according to an embodiment of the invention.
Figure 10B:
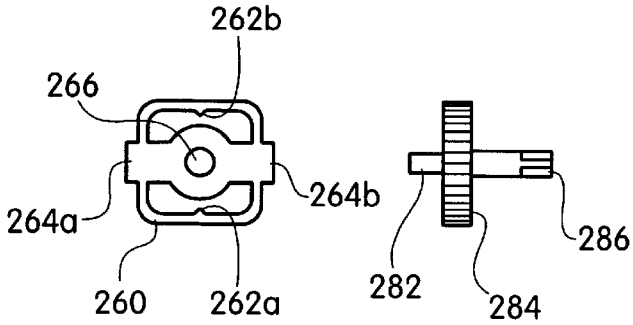
Figure 11:
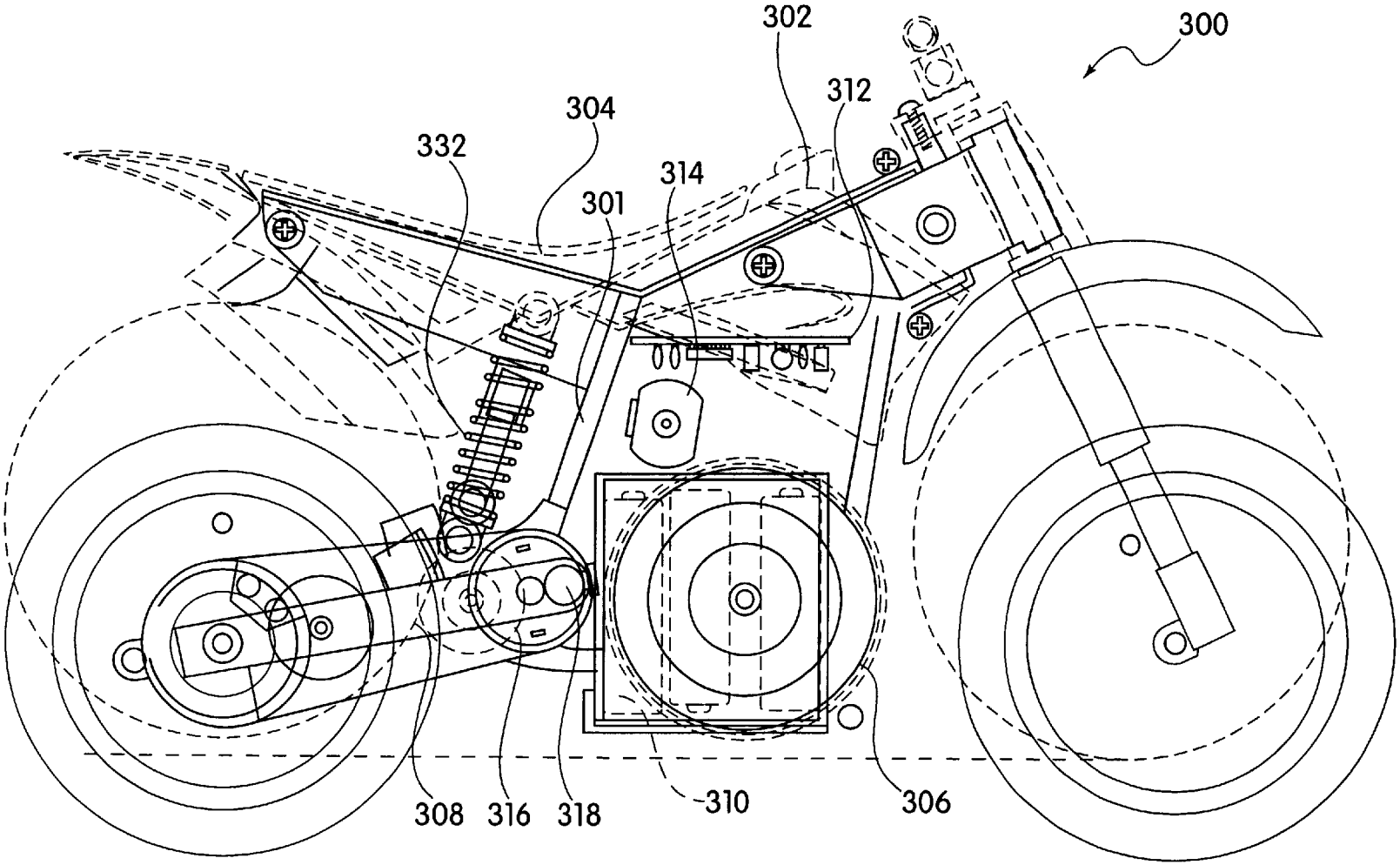
FIG. 11 is a right side, partial phantom view of a radio controlled two wheeled vehicle according to another embodiment of the invention.
Figure 12:
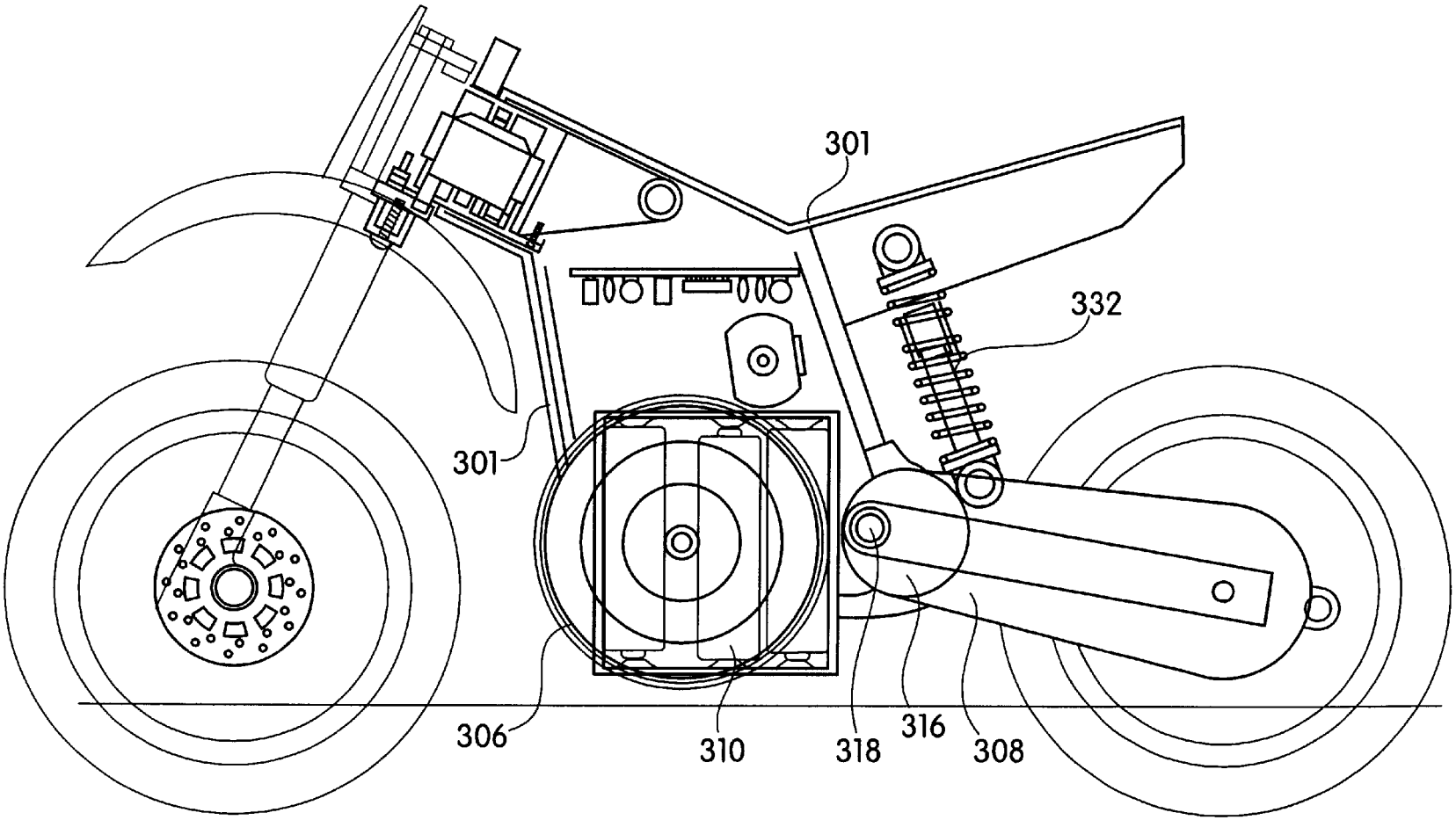
FIG. 12 is a left side, partial phantom view of a radio controlled two wheeled vehicle according to another embodiment of the invention.
Figure 13:
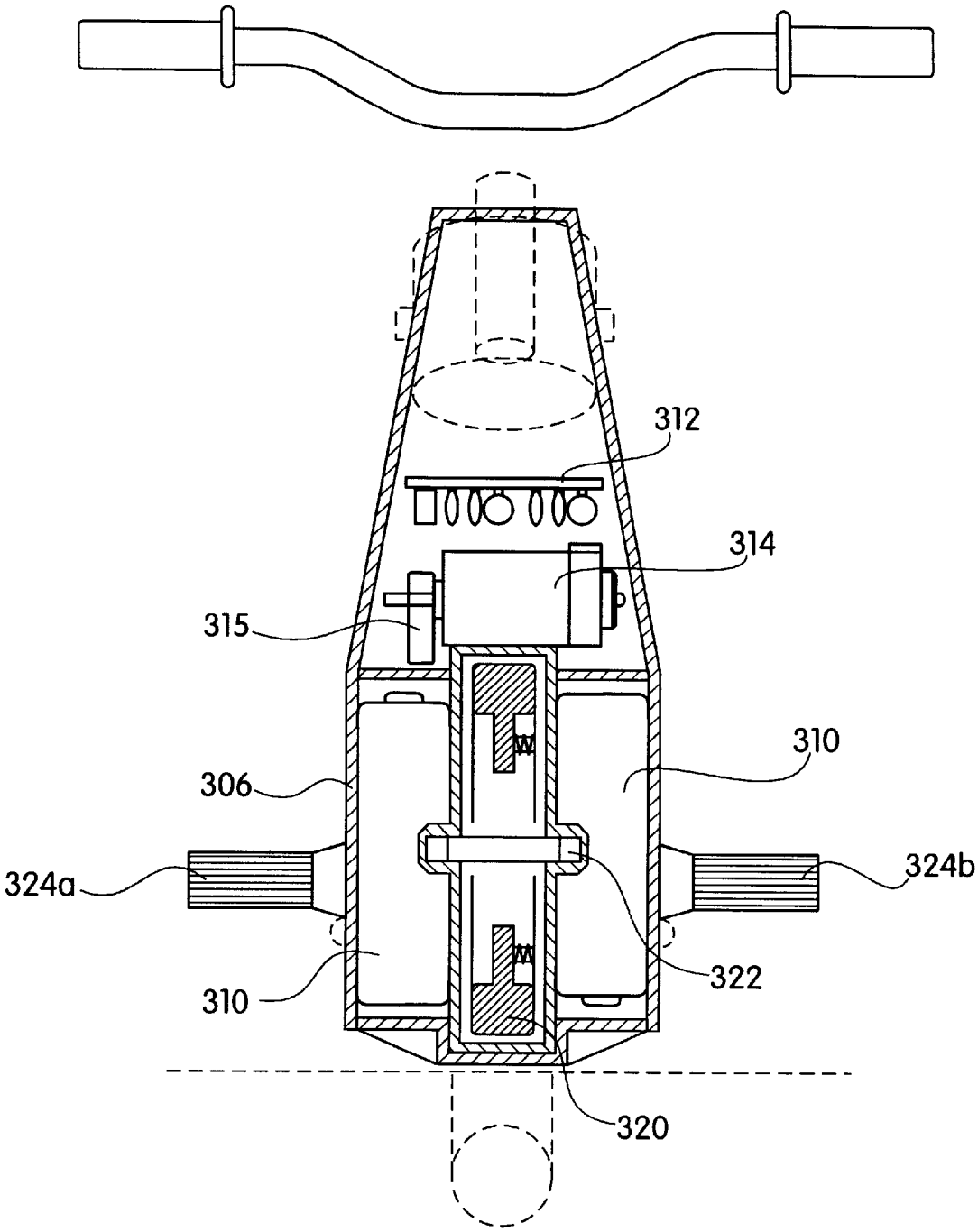
FIG. 13 is a partial cross-sectional view of the radio controlled two wheeled vehicle according to an embodiment of the invention.
Figure 14:
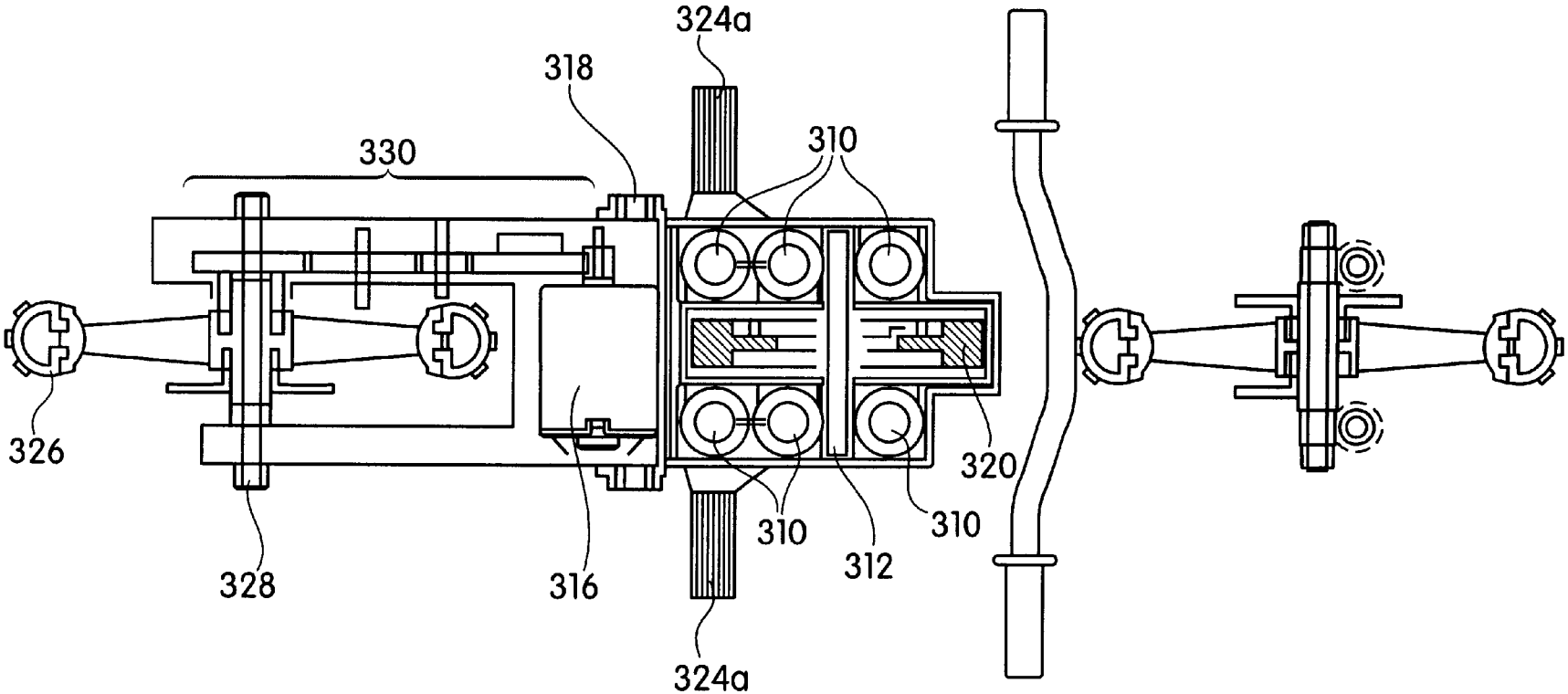
FIG. 14 is a partial cross-sectional view of the radio controlled two wheeled vehicle according to an embodiment of the invention.

FIGS. 10*a* and 10*b* show an embodiment of the detent system implemented into the action figure shoulder and/or hip joints. A detent cage 260 is disposed within the torso 201 and positioned to receive a spur gear corresponding to the limb connected to the same. The detent cage includes internal protrusions or flanges 262*a* and 262*b*, a centrally located hole 266 and external protrusions/flanges 264*a* and 264*b*.

By way of example, the operation of the detent cage will be described with respect to the hip joint mechanism of FIG. 10*b*. The hip joint includes a spur gear 284 having a keyed shaft 286 on one side and a non-keyed shaft on the other. The shaft 286 is inserted into hole 266 of detent cage 260 such that the spur gear 284 is operably positioned within the cage and detents 262*a* and 262*b* engage between the teeth of the gear 284. The external protrusions/flanges are used to retain the detent cage within the torso 201 of the action figure in a non-movable manner. Once the detent cage 260 is mounted within the torso 201, the keyed end 286 of the shaft is mated with a leg having a corresponding mating key arrangement. When the leg is attached in this manner, the detents 262*a* and 262*b* engage gear 284 and provide a very rigid and selective positioning of the leg as desired by the user. The rotation of gear 284 within detent cage 260 provides a very secure positioning system for the legs and allows almost very finite adjustments in the rotative position without compromising the integrity and strength of the leg position at any time.

FIG. 10*a* shows an embodiment of the shoulder shaft 252 having a shaft end 272 adapted for insertion into hole 266 in detent cage 260, a keyed portion 274 and an arm engaging portion 280. A spur gear 254 is inserted into detent cage 260, and includes a keyed hole 270 for mating engagement with keyed portion 274. A collar 276 prevents shaft 252 from laterally sliding out of the torso 201 and thereby maintains the mating engagement with gear 254 and detent cage 260. An arm is connected to the arm engaging portion 280 using the central hole 278. The outer surface of arm engaging portion is rounded and enables full movement of the arm in a direction indicated by arrow 258, while the shaft 252 is rotated about axis 256 as shown by arrow 259.

In accordance with this embodiment of the shoulder joint mechanism, the rounded surface of arm engaging portion 180 enables a smooth lateral movement of the shoulder joint in a direction corresponding with the curved surface of portion 180, and thereby provides a second degree of motion apart from rotation about axis 256. This two degree of motion provides a realistic action figure that can be positioned in many different positions, including various stunt poses.

FIGS. 11–14 show another embodiment of a two wheeled radio controlled vehicle according to the present invention. In this embodiment, the vehicle is styled like a motorcycle and includes additional modifications to the placement of various components.

The motorcycle 300 includes a fuel tank 302 and a seat 304 in the style of a motocross bike. Mechanically speaking, the motorcycle 300 includes a housing 306 that is disposed between the front and rear wheels and includes a plurality of batteries 310 and the flywheel 320 (FIGS. 13 and 14) of the stabilization system. A swing arm 308 is pivotally connected to the chassis of the motorcycle at a pivot point 318. Swing arm 308, in conjunction with shock absorber 332 provides realistic suspension action to the motorcycle during operation. The disposition of the batteries 310 in housing 306 along with the flywheel 320 places an increased percentage of the overall weight of the motorcycle in the lower central portion of the same. As such, it will be clear that this design substantially lowers the center of gravity and lowers the center of the flywheel for optimal gyroscopic effect of the toy and thereby increases the operating stability of the motorcycle, especially at lower speeds.

The flywheel or stability system motor 314 is preferably mounted above housing 306 and includes a spur gear 315 and others (not shown) to drive flywheel 320 independent of drive motor 316. In addition, the printed circuit board containing the electronics necessary for operation is disposed in the area under the fuel tank 302 and above housing 306.

The drive motor 316 is mounted within the swing arm assembly 308 and includes spur gears 33 (FIG. 14) that are connected to the rear axle 328 of rear wheel 326 for selectively driving the same. As with the previous embodiments, drive motor 316 is operably independent from flywheel drive motor 314 and therefore enables the same to drive the flywheel 320 at a constant speed irrespective of the operation speed of the drive motor 316.

Foot pegs 324*a* and 324*b* (FIGS. 13 and 14) provide foot rests for the action figure attached to the motorcycle during operation, and also provide an area for the hand clips 202 and/or foot clips 206 to engage for stunt positioning of the figure on the motorcycle.

While there have been shown, described and pointed out fundamental novel features of the invention as applied to preferred embodiments thereof, it will be understood that various omissions, substitutions, changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention.

What is claimed is:

1. A radio controlled two-wheeled toy vehicle comprising:

a body having a chassis with front and rear ends and a central portion between said ends, a front wheel fork assembly connected to said front end of the body, and handlebars connected to the front wheel fork assembly;

front and rear wheels operatively connected to and providing support for the respective front and rear ends, said front wheel being rotatably mounted on said front wheel fork assembly;

a steering mechanism connected to said front wheel fork and operative to steer the toy vehicle in a desired direction;

a drive system for selectively driving the rear wheel of the toy vehicle;

a stability system housing connected to the chassis and being disposed between the front and rear wheels;

a gyro based stability system disposed in said housing and being operatively independent from said drive system and said steering mechanism for increasing the stability of the toy vehicle during operation;

circuitry for receiving radio commands from a remote transmitter and controlling said steering mechanism and said drive system in response to received radio commands; and power supply means disposed in said stability system housing for providing power to said circuitry and said stability system.

2. The toy vehicle according to claim 1, wherein said body further comprises:

a swing arm having one end pivotally connected to the chassis and the rear wheel attached to an opposing end.

3. The toy vehicle according to claim 2, wherein said drive system comprises:

a drive motor disposed within said swing arm; and a first transmission operatively connected to said drive motor and said rear wheel, said drive motor selectively driving said rear wheel.

4. The toy vehicle according to claim 2, wherein said stability system comprises:

a flywheel drive motor above said stability system housing;

a flywheel rotatably disposed in said stability system housing; and a second transmission operatively connected to said flywheel drive motor and said flywheel, wherein said flywheel drive motor and said second transmission maintain said flywheel in a constant rotating motion during operation independent of the operation of said drive system.

5. The toy vehicle according to claim 2, wherein said power supply means further comprises batteries disposed in said housing around said flywheel for providing power to said circuitry, wherein said circuitry comprises a circuit board disposed above said housing.

6. The toy vehicle according to claim 1, wherein said steering mechanism comprises:

a C-shaped upper fork bushing sleeve connected to a top of the fork assembly, said bushing sleeve having a central axis;

a steering guide tab disposed at a bottom of said C-shaped upper fork bushing sleeve and having a slot;

a steering coil housing having a cylindrical bushing adapted to be co-axially disposed within said C-shaped upper fork bushing sleeve;

a ring magnet disposed within said steering coil housing; and a steering coil disposed within said steering coil housing and having a downwardly extending peg adapted to pass through said housing and engage said slot in said steering guide tab;

wherein actuation of said steering coil causes said peg to be selectively moved in one of a clockwise and counterclockwise direction thereby rotating said C-shaped upper fork bushing sleeve and effecting rotation of said front fork assembly.

7. The toy vehicle according to claim 6, wherein said C-shaped upper fork bushing sleeve comprises C-slot edges which act to limit the rotation of said C-shaped upper fork bushing sleeve around said cylindrical bushing thereby limiting an angle of steering action for the front wheel.

8. The toy vehicle according to claim 1, further comprising an action figure having shoulders, arms, legs, hands, feet, a body, a plurality of joints in the shoulders, arms, legs, hands, feet and body and connection means disposed in said hands and said feet for enabling releasable connection of said action figure to foot pegs and handlebars of the toy vehicle.

9. The toy vehicle according to claim 8, further comprising stunt pegs disposed at said front and rear ends of the toy vehicle, said action figure hands and feet being releasably connectable to said stunt pegs.

10. The toy vehicle according to claim 8, wherein said connection means in said feet comprises a retractable clip being selectively retractable from the feet when needed for securing the feet to one of said stunt pegs or handlebars.

11. The toy vehicle according to claim 8, further comprising a shoulder joint where the arms meet the body and a hip joint where the legs meet the body, wherein said shoulder and hip joints further comprise a detent system for selectively retaining a desired position of the attached leg or arm.

12. A radio controlled two-wheeled toy vehicle comprising:

a body having front and rear ends, a front wheel fork assembly operatively connected to said front end of the body, a handlebar assembly attached to the front wheel fork assembly, and a swing arm pivotally connected to the body;

front and rear wheels operatively connected to and providing support for the respective front and rear ends, said front wheel being rotatably mounted on said front wheel fork assembly, said rear wheel being rotatably mounted on an end of said swing arm;

a stability system housing disposed between said front and rear ends:

a gyro based stability system disposed in said stability system housing for increasing the stability of the toy vehicle during operation;

circuitry for receiving radio commands from a remote transmitter and controlling the toy vehicle in response to received radio commands;

power supply means disposed in said stability system housing for providing power to said circuitry and said stability system: and a steering mechanism connected to said front wheel fork and said circuitry and operative to steer the toy vehicle in a desired direction, said stability system being operatively independent of said steering mechanism.

13. The toy vehicle according to claim 12, further comprising:

a drive system connected to said body for selectively driving the rear wheel of the toy vehicle.

14. The toy vehicle according to claim 13, wherein said stability system comprises:

a flywheel drive motor disposed outside said housing;

a flywheel rotatably disposed within said stability system housing and having a central axis of rotation; and a stability system transmission operatively connected to said flywheel drive motor and said flywheel, wherein said flywheel drive motor and said stability system transmission maintain said flywheel in a constant rotating motion during operation independent of said drive system, said constant rotating motion having a substantially faster revolution per minute speed than said drive system.

15. The toy vehicle according to claim 13, wherein said steering mechanism comprises:

a C-shaped upper fork bushing sleeve connected to the fork assembly, said bushing sleeve having a central axis;

a steering guide tab disposed at a bottom of said C-shaped upper fork bushing sleeve and having a slot;

a steering coil housing having a cylindrical bushing adapted to be co-axially disposed within said C-shaped upper fork bushing sleeve;

a ring magnet disposed within said steering coil housing; and a steering coil disposed within said steering coil housing and having a downwardly extending peg adapted to pass through said housing and engage said slot in said steering guide tab;

wherein actuation of said steering coil causes said peg to be selectively moved in one of a clockwise and counterclockwise direction thereby rotating said C-shaped upper fork bushing sleeve and effecting rotation of said front fork assembly.

16. The toy vehicle according to claim 13, further comprising batteries disposed in said stability system housing around said flywheel for providing power to said circuitry, wherein said circuitry comprises a circuit board disposed above said housing.

17. The toy vehicle according to claim 16, further comprising an action figure having arms, legs, hands, feet, a body, a plurality of joints in the arms, legs, hands, feet and body and connection means disposed in said hands and said feet for enabling releasable connection of said action figure to foot pegs and handlebars of the toy vehicle.

18. The toy vehicle according to claim 17, further comprising stunt pegs disposed at said front and rear ends of the toy vehicle, said action figure hands and feet being releasably connectable to said stunt pegs.

19. The toy vehicle according to claim 18, wherein said connection means in said feet comprises a retractable clip selectively retractable from the feet when needed for securing the feet to one of said stunt pegs or handlebars.

20. The toy vehicle according to claim 18, further comprising a shoulder joint where the arms meet the body and a hip joint where the legs meet the body, wherein said shoulder and hip joints further comprise a detent system for selectively retaining a desired position of the attached leg or arm.

21. The toy vehicle according to claim 13, wherein said drive system comprises:

a drive motor; and a drive transmission operatively connected to said drive motor and said rear wheel, said drive motor selectively driving said rear wheel in response to received radio commands;

wherein said drive motor and said drive transmission is disposed in said swing arm.

22. The toy vehicle according to claim 12, wherein said stability system is user controllable by the remote transmitter and said circuitry.

* * * * *